United States Patent [19]

Forte

[11] Patent Number: 4,498,980

[45] Date of Patent: Feb. 12, 1985

[54] SEPARATION OF AROMATIC AND NONAROMATIC COMPONENTS IN MIXED HYDROCARBON FEEDS

[75] Inventor: Paulino Forte, Yonkers, N.Y.

[73] Assignee: Union Carbide Corporation, Danbury, Conn.

[21] Appl. No.: 465,914

[22] Filed: Feb. 14, 1983

[51] Int. Cl.[3] ..... C10G 21/16

[52] U.S. Cl. ..... 208/321; 208/323

[58] Field of Search ..... 208/311, 321, 322, 323, 208/324, 333, 334; 585/804; 252/364

[56] References Cited

U.S. PATENT DOCUMENTS

| | | | |
|---|---|---|---|
| 2,246,297 | 6/1941 | Duncan et al. | 208/324 |
| 2,261,287 | 11/1941 | Read | 208/321 X |
| 2,315,057 | 3/1943 | Holmes et al. | 208/311 |
| 2,360,801 | 10/1944 | Pierotti | 208/325 |
| 2,360,859 | 10/1944 | Evans et al. | 208/325 |
| 2,834,820 | 5/1958 | Bloch | 208/334 |
| 2,902,428 | 9/1959 | Kimberlin, Jr. et al. | 208/333 |
| 2,910,518 | 10/1959 | Lampert et al. | 208/321 |
| 3,725,257 | 5/1973 | Cavenaghi et al. | 208/321 X |
| 4,179,362 | 12/1979 | Irani et al. | 208/321 |
| 4,260,476 | 4/1981 | Vidveira et al. | 208/333 X |

*Primary Examiner*—Delbert E. Gantz
*Assistant Examiner*—Glenn A. Caldarola
*Attorney, Agent, or Firm*—Gary L. Wamer

[57] ABSTRACT

The separation of aromatic and nonaromatic containing hydrocarbon feeds is provided by use of an extraction-separation process using mixed extraction solvents.

The term "mixed extraction solvent" as used herein shall mean a solvent mixture comprising a "solvent" component and a "cosolvent" component, as hereinafter defined.

The "solvents" component employed in the instant process are the low molecular weight polyalkylene glycols of the formula:

$$HO—[CHR_1—(CR_2R_3)_n—O]_m—H$$

wherein n is an integer from 1 to 5 and is preferably the integer 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, araalkyl or alkylaryl and are preferably hydrogen and alkyl having between 1 and about 10 carbon atoms and most preferably are hydrogen.

The "cosolvent" component employed herein is a glycol ether of the formula $$R_4O—[CHR_5—(CHR_6—)—_xO]_y—R_7$$

wherein $R_4$, $R_5$, $R_6$ and $R_7$ may be hydrogen alkyl, aryl, aralkyl, alkylaryl and mixtures thereof with the proviso that $R_4$ or $R_7$ are not both hydrogen.

31 Claims, 2 Drawing Figures

SEPARATION OF AROMATIC AND NONAROMATIC COMPONENTS IN MIXED HYDROCARBON FEEDS

FIELD OF THE INVENTION

The instant process relates to an improved process for the separation of aromatic and nonaromatic hydrocarbons from a mixed hydrocarbon feed, and more particularly, to the separation of aromatic and nonaromatic hydrocarbons in high yields from a mixed aromatic, naphthenic and paraffinic hydrocarbon feed. Further, said process significantly decreases the energy requirements necessary for the separation of aromatic and nonaromatic hydrocarbons. The process is particularly well adapted to the separation of aromatics from naphthenic/paraffinic hydrocarbons in a mixed hydrocarbon feed wherein the nonaromatic component comprises mineral oils and is particularly well-suited for lubricating oils (hereinafter referred to as "lube oils").

BACKGROUND

The separation of aromatic and nonaromatic hydrocarbons (generally referred to as dearomatization) from mixed hydrocarbon feeds has long been recognized as necessary and advantageous for a number of varied reasons. For example, when a BTX fraction (benzene, toluene and xylene) is the aromatic fraction it may be used as a raw material in the manufacture of petrochemicals, or as an additive for gasoline to increase its octane rating. Further, the nonaromatic fraction derived from these mixed feeds have varied uses as fuels, solvents and the like and, therefore, are also highly desirable. Such uses for the aromatic and nonaromatic fractions have resulted in the development of numerous dearomatization processes.

Of particular interest and difficulty is the separation of the complex components present in lube oils, wherein the removal of aromatic-type hydrocarbons is necessary to improve the viscosity index, thermal and oxidation stability, and color of the lube oils. The presence of aromatic-type hydrocarbons in lube oils affects the quality of these oils due to the low viscosity index, poor thermal and oxidation stability, high carbon residue, and poor color of such aromatic-type hydrocarbons. The aromatic-type hydrocarbons present in lube oils differ significantly from the BTX fraction found in light hydrocarbon mixtures used in the production of gasoline and, as a result, present vastly different separation problems.

Various processes have been suggested for the separation of the aromatic and nonaromatic hydrocarbons of a mixed feed wherein the aromatic is a BTX fraction. Typical of these processes is a process employing an extraction column for separation of a BTX fraction wherein a glycol solvent/water solution, BTX and a reflux stream is introduced to a two step distillation column. BTX is then distilled to remove water and entrained glycol. Similarly, a process has been suggested wherein two distillation columns are employed with the BTX fraction and water being distilled in the second column. In addition, a process using two distillation columns wherein the second column is employed to distill the BTX fraction and other components, has been suggested.

The aforementioned processes have not proven satisfactory when the separation of the aromatic hydrocarbon component has been other than a BTX fraction, particularly when the process was employed for the dearomatization of lubricating oils. Therefore, a number of processes have been proposed for the dearomatization of mixed hydrocarbon feeds containing various aromatic hydrocarbons. These processes have been directed, in large part, to the choice of the extraction solvent. For example, U.S. Pat. Nos. 2,400,732 and 2,402,799 disclose extraction/distillations employing a solvent containing primarily water as the extraction solvent. Numerous water based solvents have been suggested for the extraction of aromatic hydrocarbons from mixed hydrocarbon feeds but to date such extraction solvents have not proven to be satisfactory. These include water based extraction solvents such as: glycol/water wherein up to 50 percent glycol is added (U.S. Pat. No. 2,400,802); methanol/water (U.S. Pat. No. 3,985,644); water/non-oxygenated organic solvents (U.S. Pat. No. 2,298,791); water/amines (U.S. Pat. No. 2,401,852); and water/inorganic salts, acid or bases, or organic substances (U.S. Pat. No. 2,403,485). The problems associated with employing water-based extraction solvents, are well known in the prior art, e.g., use of extremely high pressures.

Various processes have been suggested to help overcome the problems associated with employing water based extraction solvents. For example, U.S. Pat. No. 1,783,203 discloses the use of dry alcohols ($C_1$–$C_3$) for treating heavy petroleum oils. The problems relating to the flammability and toxicity of such alcohols are well known in the art. U.S. Pat. No. 1,908,018 discloses the use of certain ethylene glycol ethers, i.e., ethers of ethylene glycol and diethylene glycol, and their acyl derivatives in a process for refining mineral oils. The process involves separating the paraffinic and naphthenic portion by admixture of the oil feed with an ethylene glycol ether followed by cooling and agitation of the entire mixture to provide a more paraffinic upper layer and a more naphthenic lower layer. As is clear from the patent, the process is not directed to the separation of aromatic and non-aromatics. The solvent is then removed by vacuum distillation (see beginning at column 4, line 129 et seq.) The process does not employ solvent mixtures of ethylene glycol ethers with other solvents nor does the process employ glycol ethers above diethylene glycol ethers. Further the process is necessarily energy intensive owing to the use of distillation steps for the removal of the extraction solvent.

U.S. Pat. No. 2,337,732 discloses the use of ethanolamines for removing aromatics from a hydrocarbon distillate, comprising gasolines or light hydrocarbons ($C_1$–$C_5$), by an extraction-distillation process. U.S. Pat. No. 2,295,612 discloses the use of low molecular weight polyhydric alcohols for separating aromatic mixtures to obtain resin-forming compounds. U.S. Pat. No. 2,129,283 discloses the use of a beta, beta'-dichloro diethyl ether and 2–30% propylene glycol as the solvent for extracting naphthenic impurities from lubricating oils at temperatures from 120° F. to 200° F.. U.S. Pat. No. 3,379,788 discloses the use of alkylene oxide adducts of phenyl glycidyl ether and U.S. Pat. No. 2,834,820 discloses the use of mixed alkylene oxide adducts of ethylene or propylene oxide as solvents in dearomatization processes.

To overcome the relatively low yields, purities and solvent recovery problems of the above processes several dearomatization processes have been suggested employing extraction and distillation. These include:

solvent extraction-steam distillation processes (such as those disclosed in U.S. Pat. Nos. 3,417,033; 3,714,034; 3,779,904; 3,788,980, 3,755,154 and 3,966,589); processes employing multiple extraction zones and azeotropic distillation (e.g. U.S. Pat. No. 3,789,077); processes employing distillation and stripping columns (U.S. Pat. Nos. 4,048,062 and 4,177,137); and multiple distillation processes (e.g. U.S. Pat. No. 3,461,066). Unfortunately these processes employ costly distillation of the solvent. Further, high capital and energy costs are generally associated with employing such processes. Therefore, alternative processes have been sought whereby these problems may be minimized.

U.S. Pat. No. 3,431,199 discloses a method of separating aromatic hydrocarbons from a mixed hydrocarbon feed by use of solvents comprising diethylene glycol, dipropylene glycol, sulfolane and mixtures thereof. The process is directed to the separation of light aromatics by extraction at temperatures preferably between 80° and 130° C. and employs azeotropic distillation with acetone to effect separation of the aromatic hydrocarbons. The process preferably employs solvent with 2% to 8% by weight water.

U.S. Pat. No. 3,551,327 discloses an extraction distillation process which employs a sulfolane-type solvent.

U.S. Pat. No. 3,985,644 discloses a method of separating naphtha into aromatic and paraffin-rich fractions with a methanol-water mixtures. The solvent is separated from the aromatic-rich phase by lowering the temperature of the mixture. As indicated therein, the solvent comprises methanol/water mixtures. These are highly toxic and flammable mixtures.

U.S. Pat. No. 4,086,159 discloses a method for separating aromatic hydrocarbons from mixed hydrocarbon feeds by use of an ethoxylate alkane polyol solvent in an extraction-distillation process. The ethoxylated alkane polyol solvents high boiling point provides for the recovery of high boiling aromatics such as ethylbenzene and polysubstituted benzenes. The process necessarily requires sizable quantities of energy to carry out the energy intensive distillation steps.

U.S. Pat. No. 4,179,362 discloses a method for separating aromatic-containing petroleum fractions into aromatic-rich and non-aromatic hydrocarbon streams by use of a methanol/water extraction solvent (having at least 10 volume percent water in the extraction solvent) in an extraction zone at a temperature of about 150°-450° F. The extraction employs water in the extraction step to reduce hydrocarbon solubility in the aromatic-rich extract. The extraction step is followed by further additions of water (distilled water) to the aromatic-rich extract such that the water/methanol solvent contains at least 80% water, by volume. The water and methanol must then be removed by flash distillation, an energy intensive process, or by some other process such as using super critical $CO_2$ as an extraction solvent. The use of methanol/water solvents for treating higher distillates tends to require higher process pressures and suffers from the safety constraints associated with methanol/water solvents, e.g., high flammability and high toxicity.

The above processes show the intense interest in developing a dearomatization process which lowers the cost of those processes heretofore used commercially. U.S. Pat. No. 3,985,644 mentions one such method for achieving this goal, i.e., by reducing the use of energy-intensive steps, e.g., distillation.

The dearomatization of lube oils is of particular interest. Dearomatized lubricating oils are, generally speaking, naphthenic-and or paraffinic-type viscous materials having a low rate of viscosity change with change in temperature, i.e., relatively high viscosity index, a high degree of thermal and oxidation stability, low carbon-forming tendency, good color, and high flash points. Lubricating oil feedstocks are generally recovered as distillates or bottoms from the vacuum distillation of crude oils. A crude lube oil fraction contains many different chemical components, e.g., paraffins, naphthenes, aromatics, and the like. In order to obtain refined lubricating oils of relatively good quality and high viscosity index, the practice has been to remove components, such as aromatic and polyaromatic compounds, which tend to lower the viscosity index of the lube oil. The removal of these aromatic components has heretofore been carried out by processes as above-described and processes such as disclosed in U.S. Pat. Nos. 2,079,885; 2,342,205; 3,600,302; 2,773,005; 3,291,728; 3,788,980; and 3,883,420.

U.S. Pat. No. 2,079,885 discloses a process for refining hydrocarbon oils containing aromatic and non-aromatic components by counter current extraction at elevated temperatures with selective solvents such as furfural or phenol, cooling the aromatic-rich extract and oiling out the raffinate and recycling the oiled out raffinate. Unfortunately such a process results in some raffinate losses in the aromatic-rich extract.

U.S. Pat. No. 2,342,205 discloses a solvent recovery scheme wherein aliphatic and aromatic hydrocarbons are washed with water and then distilled.

U.S. Pat. No. 3,600,302 discloses a method of upgrading petroleum distillate fractions by extraction with a solvent comprising an aromatic organic compound having a 6 membered ring containing at least one polar functional group, e.g., phenol, and a lower glycol ether such as ethylene glycol monomethylether or diethylene glycol monomethyl ether. The process employs conventional distillation means to separate the solvent from the aromatic and non-aromatic phases and employs the lower glcol ether to decrease the capacity of the phenol solvent owing to the extremely high capacity of phenol at the high extraction temperatures (see col. 3, line 25 et seq).

U.S. Pat. No. 2,773,005 discloses a process wherein light lubricating oils are extracted by use of phenol and water. The phenol is recovered from a second extract fraction wherein said extract fraction contains aromatic-type hydrocarbons and phenol (extraction solvent). Thus, the process requires regeneration of the extraction solvent by means of additional separation processes in that the "second extract fraction" contains phenol (a relatively toxic compound) and aromatic-type compounds.

U.S. Pat. No. 3,291,728 discloses a process wherein a raffinate and extract fraction from an extraction process are washed with 25 percent to 50 percent, by volume, water.

U.S. Pat. No. 3,788,980 discloses a process for the recovery of aromatic hydrocarbons wherein a feedstock is contacted with a mixture of water and a solvent. The mixture containing aromatics is introduced to a distillation zone maintained at the boiling point of the mixture of aromatics with steam being introduced at the bottom of the distillation zone. Thus, a distillation zone is necessarily employed to remove the aromatic-type compounds.

U.S. Pat. No. 3,883,420 discloses a process for removing aromatic hydrocarbons from an extract phase (containing aromatic and extraction solvent) by use of a mixture of steam and a lower molecular weight paraffinic hydrocarbon (solvent). The solvent is recovered by steam stripping or by extractive distillation followed by a solvent recovery column.

In copending application U.S. Ser. No. 164,039, filed June 30, 1980, commonly assigned, a solvent extraction-solvent decantation process is disclosed wherein solvent purification with mixed hydrocarbon feed or raffinate can be employed. The instant process eliminates these solvent purification steps.

In copending application U.S. Ser. No. 267,427, filed June 4, 1981, commonly assigned, there is disclosed a process for the separation of aromatic and nonaromatic containing feedstocks by use of a unique extraction-decantation process wherein the extraction solvent as preferably a low molecular weight polyalkylene glycol. The instant process provides for an improved process by use of improved mixed extraction solvents.

The process of this invention is to be distinguished from the prior art in that the instant process provides an extraction-separation process that is more economically advantageous, i.e., energy efficient, and overcomes problems inherent in many of the above-described processes.

SUMMARY OF THE INVENTION

The instant invention provides a process for the separation of aromatic and nonaromatic hydrocarbons from a mixed hydrocarbon feed in which an aromatic selective solvent(s) comprising two or more components is employed to provide an improved process. The instant process comprises an extraction-separation process wherein aromatic and nonaromatic hydrocarbons are separated by selecting the extraction solvent so as to contain therein a primary solvent component, as hereinafter described and a cosolvent component, such that the process has improved capacity, selectivity between aromatic and non-aromatic products and improved heat duty requirements for a wide range of feedstocks.

According to this invention, a mixed hydrocarbon feed (containing aromatic and nonaromatic components and referred to herein as "feed") is effectively separated with low energy consumption in a continuous solvent extraction-solvent separation process comprising tne following steps:

(a) contacting the hydrocarbon feed with a mixed extraction solvent in an extraction zone, at a temperature of at least about 150° C. to provide a solvent phase and a raffinate phase;

(b) cooling the solvent phase;

(c) introducing said cooled solvent phase to a separation zone and introducing therewith about 0.1 to about 25.0 percent by weight of an anti-solvent for said aromatic hydrocarbons in said solvent phase to provide an extract phase containing aromatic hydrocarbons and a solvent-rich phase containing mixed extraction solvent and anti-solvent;

(d) removing anti-solvent from said solvent-rich phase and recycling said solvent-rich phase to the extraction zone of step (a); and (e) recovering the extract phase of step (c) and the raffinate of step (a).

Any entrained or dissolved solvent may be removed from the extract phase and raffinate by means of a water wash process.

DESCRIPTION OF THE INVENTION

Figure 1:
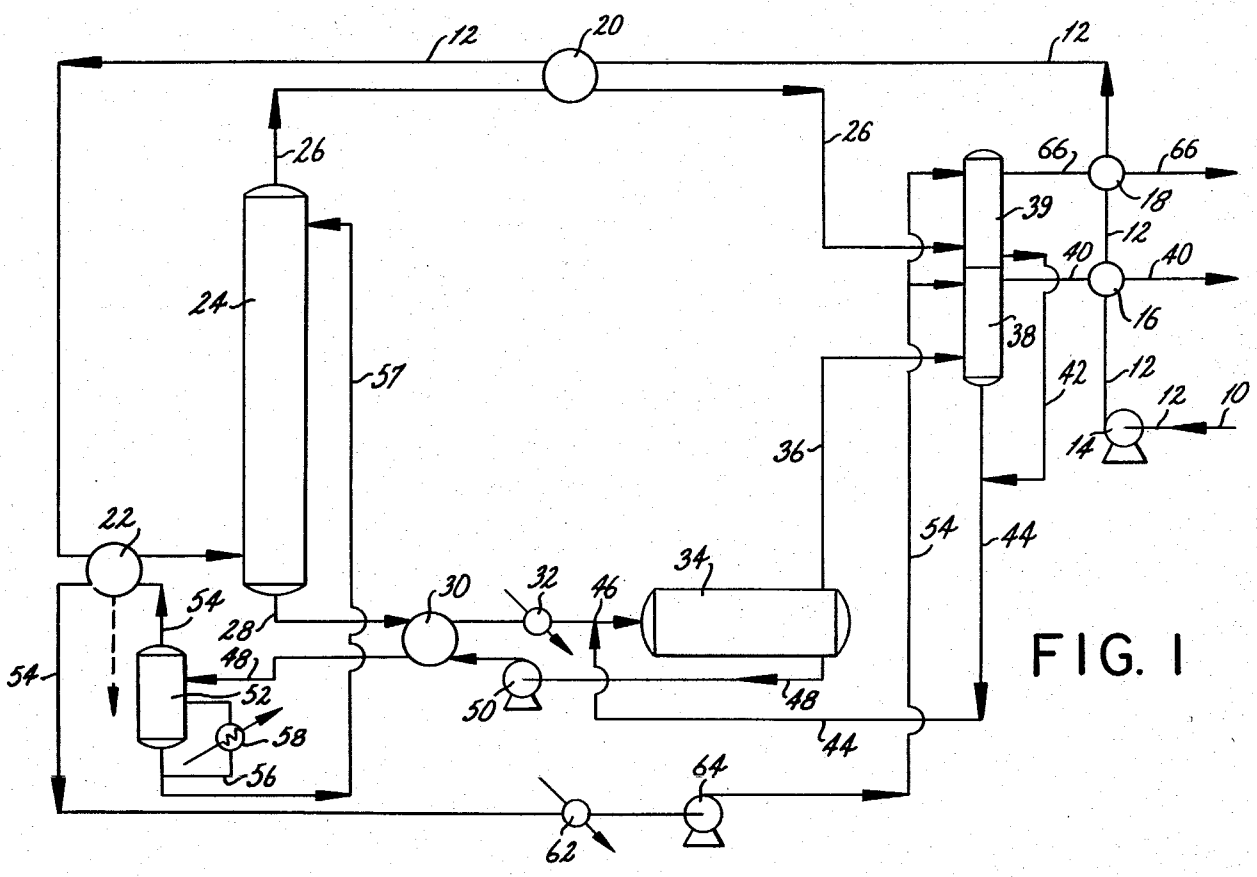
FIG. 1 is a schematic flow diagram of an illustrative embodiment of the invention.

As noted above, there has historically been and continues to be an industrial need for an energy efficient process for the separation of aromatic and nonaromatic hydrocarbons present in mixed hydrocarbon feeds. Naphthas, heating oils, light oils, cracked gasolines, dripolenes, lubricating oils (light distillates to heavy distillates) kerosene and the like, can contain up to 90 percent by weight aromatic-type hydrocarbons, e.g., BTX or polyaromatics. The separation of aromatic and nonaromatic hydrocarbons is of particular interest in the dearomatization of crude lube oils. The components which make up these hydrocarbon feed streams are well known in the art and tney will not be extensively discussed herein except to note that the mixed hydrocarbon feed employed herein may be any petroleum of the common distillation fractions containing one or more aromatics components including: naphthas (virgin or cracked); kerosene; gasoline; heating oils; lubricating oils; (light distillates heavy distillates, bright stock and residual oils); jet fuels; and recycle oils. Preferably, the feed stream is a lube oil fraction such as a light distillates to heavy distillate, bright stock, etc., which have boiling points between about 400° F. and about 1100° F.

The aromatic hydrocarbons present in heavy hydrocarbon feeds, e.g., lubricating oils, generally include: alkylbenzenes, indanes, tetralins, indenes, naphthalenes, fluorenes, acenaphthalenes, biphenyls, phenanltrenes, anthracenes, diacenaphthalenes, pyrenes, chripenes, diaceanthrancenes, benzpyrenes and other various aromatic feed components.

The instant process provides for significantly improved processing of feedstocks containing aromatic and nonaromatic components. The use of the hereinafter described "mixed extraction solvent" in the instant extraction separation process provides several significant advantages. Firstly, the use of a mixed extraction solvent provides for the use of lower solvent to feedstock ratios (lower solvent recirculation rates) which reduces the size of the equipment required for the process and, therefore, the required capital investment. Secondly, the use of the mixed extraction solvents decreases the amount of water employed for solvent separation and as a result the amount of water employed to wash the raffinate and extract in order to remove solvent entrained and in solution, as hereinafter described with reference to the drawings. This decrease in the amount of water required in the solvent separation step decreases the net energy requirements of the process. Thirdly, the use of tne mixed extraction solvent and the use of lesser amounts of water has made the net energy consumption of the process dependent on the total amount of feedstock treated and not on the solvent to feedstock ratio employed. This advantage makes the instant process capable of treating different feedstocks, e.g., light paraffin distillate vs. bright stock, witnout significantly increasing the energy requirements of the process. This results in savings, in terms of the energy consumption of the process, of up to 50 percent or more, based on the energy required in furfural or similar processes presently employed in the art. Fourthly, the use of the mixed extraction solvent provides a greater degree of operability to the process by use of varying amounts of tne component solvents based on the feedstock being treated. Fifthly, the use of the mixed extraction solvent, in general, permited tne use of relatively low extraction temperatures, and, thus, improves the thermal stability of the solvent.

The solvent mixtures (solvent and cosolvents), denominated herein as "mixed extraction solvent", employed in the instant process have a certain unique balance of desirable characteristics which have not heretofore been found in solvents such as fufural, phenol, methanol, and the like, including: (a) high selectivity for the aromatic feed components at the extraction temperatures; (b) high solvent capacity for the aromatic feed components at the extraction temperatures; (c) low capacity for the aromatic feed components at temperatures below the extraction temperature; (d) chemical and thermal stability under the process conditions; (e) adaptable to a wider range of feeds; and (f) the solvent and cosolvent are sufficiently miscible to permit their recycle as a single recycled component. As will be understood by one skilled in the art, the interrelation of the aforementioned characteristics is crucial to he ultimate suitability of an extraction solvent. The instant "mixed extraction solvent" provides a balance of these characteristics in the instant extraction separation process. The instant process is distinguished from processes where the extraction solvent is distilled from the aromatic extract or raffinate. In processes heretofore employed the characteristics of the extraction solvent are not so intimately related to decrease the energy requirements of the process.

As above noted the solvents and cosolvents employed in the instant process tend to be water-miscible organic liquids (at process temperatures) having a boiling point and decomposition temperature higher than the extraction temperature. The term "water-miscible" describes those solvents and cosolvents which are completely miscible with water over a wide range of temperatures and which have a high partial miscibility with water at room temperature, since the latter are usually completely miscible at process temperatures.

The term "mixed extraction solvent" as used herein shall mean a solvent mixture comprising a "solvent" component and a "cosolvent" component, as hereinafter defined.

The "solvents" component employed in the instant process are the low molecular weight polyalkylene glycols of the formula:

$$HO—[CHR_1—(CR_2R_3)_n—O]_m—H$$

wherein n is a integer from 1 to 5 and is preferably the integer 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, araalkyl or alkylaryl and are preferably hydrogen and alkyl having between 1 and about 10 carbon atoms and most preferably are hydrogen. Examples of the polyalkylene glycol solvents employable herein are diethylene glycol, triethylene glycol, tetraethylene glycol, 1,3-butylene glycol, 1,2-butylene glycol, 1,5-pentaethylene glycol, and mixtures thereof and the like. In addition, to the polyalkylene glycol solvents the solvent may be selected from the group consisting of sulfolane, furfural, n-methyl-2-pyrrolidone. Preferred solvents are diethylene glycol, triethylene glycol, tetraethylene glycol, or mixtures tnereof with tetraethylene glycol being most preferred.

The "cosolvent" component employed herein is a glycol ether of the formula $$R_4O—[CHR_5—(CHR_6—)—_xO]_y—R_7$$

wherein $R_4$, $R_5$, $R_6$ and $R_7$ may be hydrogen alkyl, aryl, aralkyl, alkylaryl and mixtures thereof with the proviso that $R_4$ or $R_7$ are not both hydrogen. The value of x is an integer from 1 to 5, preferably 1 or 2 and y may be an integer from 1 to 10 and is preferably from 2 to 7, and most preferably from 2 to 5. $R_4$, $R_5$, $R_6$ and $R_7$ are preferably selected from the group consisting of hydrogen and alkyl having 1 to about 10 caroons with the proviso that $R_4$ and $R_7$ may not both be hydrogen and most preferably $R_4$ is alkyl having from 1 to 5 carbons and $R_5$, $R_6$ and $R_7$ are hydrogen.

The mixture(s) of solvent and cosolvent is selected sucn that at least one solvent and one cosolvent are provided to form the mixed extraction solvent. The cosolvent generally comprises between aoout 0.5 and about 99 percent of the mixed extraction solvent, preferably between about 10 and about 80 percent and most preferably between about 20 and about 60 percent by weight based on the weight percent of tne cosolvent oased on the total weight of the mixed extraction solvent.

An anti-solvent is employed in the solvent separation step of the instant process and such may be most any compound that tends to decrease the solubility of the aromatic hydrocarbon in the mixed extraction solvent. Water is the preferred anti-solvent since the energy requirements of the process are significantly minimized by removing the water by distillation thereby generating steam for use in this or other processes. Further, the use of water as an antisolvent in the extraction step has been observed to provide added process versatility by correlating the selected feed with the mixed extraction solvent and the effective amount of anti-solvent present in the extraction zone. Other suitable anti-solvents are believed to include ethylene glycol, glycerine, low molecular weight alcohols and tne like. The use of low molecular weight alcohols, even at the low concentration of antisolvent employed, is not generally preferred owing to the art recognized problems associated with the use of alcohols. The effective concentration of the anti-solvent as determined in the separation zone is that amount which effectively decreases the solubility of the aromatic hydrocarbon in the mixed extraction solvent as determined by the amount of aromatic hydrocarbon in the mixed extraction solvent leaving tne separation zone. The concentration of aromatic hydrocarbons in the mixed extraction solvent leaving the separation zone is preferably less than 5 percent by weight, based on the weight of the extraction solvent and is preferably less than 3 percent by weight. The anti-solvent employed in the instant process promotes tne formation of two phases to a degree greater than that obtainable by simple cooling of the phase obtained by extraction such that an aromatic-rich extract phase and a solvent-rich phase are formed. Generally the concentration of the anti-solvent present in the separation zone is in the range of from about 0.5 to 25.0 percent by weight or higher, based on the total weight of the aromatic-rich solvent phase, with the range from about 0.5 to about 15.0 percent being preferred and the range from about 3.0 to about 10.0 being most preferred. Some portion of the anti-solvent present in the separation zone may be provided by anti-solvent which may be present in the aromatic-rich solvent phase obtained from the extraction zone as a result of amounts present due to the recycle of the mixed extraction solvent and antisolvent. As hereinbefore noted, the presence of up to about 10 percent by weight (based on the total weight of the recycled mixed extraction solvent) may be advantageous in correlating the mixed extraction solvent to changes in the feedstock. The actual concentration of the anti-solvent in the decantation zone may be higher than 25.0 percent by weight depending on tne selection of the hydrocarbon feed, aromatics present in the feed, the mixed extraction solvent employed and the like. The aforementioned concentrations designate the total anti-solvent, e.g. water, present in the separation zone irrespective of its source. Anti-solvent is preferably added to the aromatic-rich solvent phase prior to the separation zone so as to provide for improved separation therein.

Generally, to accomplish the extraction, the ratio of tne mixed extraction solvent to hydrocarbon feed in the extractor zone is in the range from about 2 to about 20 parts by volume of solvent to one part by volume of feed, the ratio from about 2 to 1 to about 15 to 1 being preferred and the ratio from about 4 to 1 to about 10 to 1 being the most preferred. The broad range for the ratio of the solvent to hydrocarbon may be expanded upon depending on the solvent, co-solvent, weight percent of solvent to cosolvent, the weight percent of anti-solvent in the mixed extraction solvent and the like. The optimum solvent to feed ratio also depends upon whether high recovery (yield) or high purity (quality) is desired, although the instant process will generally result in both high recovery and high purity.

It has been observed that by using the instant mixture of a solvent and a cosolvent as the extraction solvent that a process is provided that has a high selectivity and capacity for aromatic hydrocarbons and, further, provides a process wherein the heat duty for the process (the energy consumption of the process) is proportional to the rate at which the feed is introduced and not strictly dependent on the ratio of the solvent to feed. Thus, the instant process provides for the use of similar energy requirements for vastly different feedstocks. This important feature is not found in processes wnerein fufural, N-methyl-2-pyrrolidone are phenol is employed as the extraction solvent.

The instant process is further characterized in that the pressure at the top of the extraction zone is typically less than about 150 psig and often less than about 100 psig. This is highly advantageous in terms of ease of operation and the capital expenditure required for carrying out the separation process. The actual pressures in the extraction zone may be higher or lower depending on the particular hydrocarbon feed treated, the mixed extraction solvent employed, the selected antisolvent and its concentration, and the selected temperature at which the extraction is carried out. The pressure employed in the separation zone generally is simply that pressure which is required to cause the aromatic-rich solvent phase to pass through the separation zone althougn higher pressures may be employed if desired. Generally a small pressure drop (pressure gradient) is observed across the separation zone.

The temperature of the extraction zone is generally at least about 150° C. and is generally in the range of from about 150° C. to about 275° C., preferably in the range of from about 170° C. to about 250° C. and most preferably from about 200° C. to about 240° C. The temperature in the extraction zone is not constant throughout and there will generally be a temperature gradient up to about 30° C. or more as between the temperature of the mixed extraction solvent introduced to the extraction zone and the temperature of the phase leaving the extraction zone. The separation zone is generally maintained at a temperature in the range of from about 50° C. to about 200° C. below the temperature of the extraction zone such that the temperature is preferably in the range of from about 25° C. to about 150° C., more preferably about 25° C. to about 100° C. and most preferably from about 25° C. to about 70° C. The temperature employed in the separation zone depends, in part, upon solubility of the aromatic hydrocarbon in the mixed extraction solvent, the amount of anti-solvent present in the separation zone and the viscosity of the mixed extraction solvent at the temperature of the separation zone.

The apparatus employed in the instant process in the extraction zone, separation zone and otherwise are of conventional design. For example, an extraction column of the multistage reciprocating type containing a plurality of perforated plates centrally mounted on a vertical shaft driven by a motor in an oscillatory manner can be used as may columns containing pumps with settling zones or sieve trays with upcomers or downcomers, (Counter-current flow is generally utilized in the extraction column.) The separation in the separation zone can be conducted in a tank with no internal elements but preferably the tank contains coalescing elements or baffles to aid in the separation. The preferred separation zone comprises a coalescer with a porous media having a depth-type coalescing element (fibrous bed coalescer element). It is understood that the "separation zone" is a zone wherein phase separation is facilitated and wherein anti-solvent is present. As noted hereinabove, the anti-solvent is preferably added prior to the separation zone after the solvent phase exits the extraction zone and is cooled.

Heat exchangers, reservoirs, and solvent regenerators, if necessary, are also of conventional design as well as are the various extractors and decanters used in the various embodiments hereinafter described. The extractors employed are preferably multi-stage counter-current extractors, but can be any of the well-known types, as aforementioned.

The instant process generally provides for an overall recovery of the aromatic hydrocarbon of from about 70 to about 95 percent or better based upon the weight of aromatic in the original hydrocarbon feed and usually provides for similar recoveries for the nonaromatic hydrocarbons.

EXPERIMENTAL PROCEDURE

In carrying out the examples the extraction column comprised a Karr (TM) reciprocating plate extraction column made of 2 inch (internal diameter) glass pipe, having an internal volume of about five liters and having reciprocating plates spaced two inches apart. All internal metal parts are made of No. 316 stainless steel except the reciprocating plates which were Teflon (TM). The separation zone comprised a tank with or without baffles or a glass separator (Model No. LS-60P from Selas Corporation of America) equipped with a depth-type coalescing element. A fibrous bed coalescing element is the preferred coalescing element. The tubing employed throughout was generally No. 316 stainless steel tubing having a $\frac{3}{8}$ inch outside diameter with a 0.035 inch wall thickness. A water stripper was employed comprising a 4 inch (inside diameter) glass distillation column packed with stainless steel protruded metal packing (0.24 inch×0.24 inch).

The oil content of the various phases was determined by a gas chromatograph (Hewlett-Packard Model 5750) having a 2 millimeter×6 foot glass column packed with a 3 percent OV-101 on Chromosorb W (TM) equipped with a flame ionization dectector. The water content of the various phases was determined using a Karl-Fisher automatic titrator (Model 392) and an automatic burette (Fisher Model 395).

The viscosity index (referred to as the "VI") for the hydrocarbon feed and products were initially determined by ASTM Method D2270-75. The Viscosity Index for an oil product is a measure of the purity of that oil product with a higher Viscosity Index indicating that the oil product has a higher purity (i.e., contains less aromatics). The viscosity index of the products were determined by measurement of the refractive index of the hydrocarbon feed or product at 70° C. after having correlated the viscosity index as determined by ASTM D2270-75 to the refractive index at 70° C. The values given for the viscosity index in the examples is the viscosity index as determined by measuring the refractive index at 70° C. of the raffinate product. In addition, the yield (volume % based on the total feed volume) was calculated from the refractive index at 70° C. of the feed, raffinate and extract product. Such yields are reported for the examples hereinafter.

Temperatures and pressures were measured by conventional detection means.

Referring to FIG. 1:

The mixed hydrocarbon feed is introduced at 10 through line 12 to pump 14. The feed passes through line 12 and heat exchanger 16, 18 and 20 where it is heat exchanged with aromatic-rich extract and raffinate, respectively to preheat the feed. The feed is then heat exchanged in heat exchanger 22 with steam in line 54 (steam formed by distilling the anti-solvent, i.e., water, from the solvent phase when water is the anti-solvent) prior to introduction to extraction column (zone) 24. A mixed extraction solvent (hereinafter "extraction solvent"), preferably having a temperature in the range of from about 150° C. to about 275° C., most preferably about 200° C. to about 240° C. is introduced near the top of extraction column 24 via line 57 and percolates down column 24 removing aromatics from the hydrocarbon feed forming raffinate and an aromatic-rich solvent phase. The raffinate, containing primarily non-aromatics, exits the top of the column 24 via line 26 and in neat exchanger 20 preheats the mixed hydrocarbon feed and is cooled in turn by heat exchange with the incoming mixed hydrocarbon feed. The raffinate then passes to extractor 39 where it is contacted with water (when water is the selected anti-solvent the extraction water is preferably water removed from the extraction solvent) to recover extraction solvent present in the raffinate so as to form a water phase and a final raffinate product. Some feedstocks (e.g. bright stock and heavy distillates) may result in a raffinate with entrained solvent. The major portion of this solvent should preferably be removed prior to the aforementioned step. A second water extraction takes place in extractor 38 wherein the aromatic-rich extract from separation zone 34, discussed hereinafter, forms a water-phase (containing mixed extraction solvent) and a final aromatic product. The water-phases from extractors 38 and 39 contain primarily water and small amounts of the extraction solvent that was dissolved or entrained in the aromatic-rich extract and raffinate. The combined water-phases are recycled to separation tank (zone) 34 via line 44, as needed, if water is the selected anti-solvent.

It should be pointed out that the terms "phase" and "product" are named after their main components, which is present in the phase in an amount of at least 50% by weight and in most cases in an amount of 80% by weight or higher. The aromatic-rich solvent phase, containing primarily extraction solvent and aromatic hydrocarbons, leaves the bottom of extraction column 24 via line 28 and heat exchanger 30 where it is cooled with extraction solvent in line 48. The aromatic-rich solvent phase is further cooled to promote two phase formation, if necessary, in cooler 32. Recycled extraction solvent and anti-solvent, when water is the selected anti-solvent, are introduced via line 44 to separation tank (zone) 34. Thus, the solvent contained in line 44 is returned to the process. The anti-solvent is preferably added to the aromatic-rich solvent phase prior to separation zone 34 to further promote phase formation, e.g. at 46 of the drawing, in the separation zone although the anti-solvent may be added directly to separation zone 34 if desired. The anti-solvent in the extraction solvent/anti-solvent mixture of line 44 reduces the solubility of the aromatic hydrocarbon in the extraction solvent to a degree not obtainable by simple cooling of the aromatic-rich solvent phase. The anti-solvent is typically present in separation zone 34 at a concentration of between about 0.5% and about 25.0% by weight, based on the weight of aromatics and solvent in separation zone 34, preferably from about 0.5% to 15.0% by weight and most preferably from about 3.0% to about 10.0% by weight. The presence of the anti-solvent in the separation zone decreases the solubility of the aromatic in the extraction solvent such that preferably less than about 3% weight percent aromatic and often less than about 2% weight percent, leaves decantation tank 34 via line 48.

The aromatic-rich extract phase of separation zone 34 exits via line 36 to water-extraction column 38 where it is contacted with water (preferably water derived from the removal of water from the extraction solvent/anti-solvent mixture) from the solvent phase of separation zone 34. This extraction with water removes extrained and dissolved solvent from the aromatic-rich extract phase.

The solvent phase of separation zone 34 passes via line 48 through pump 50 to heat exchanger 30 wherein it heat exchanges witn hot aromatic-rich solvent of line 28 prior to introduction to distillation column (zone) 52. If further heating of the solvent in line 48 is desired an additional heat-exchanger (not shown) may be provided to allow heat exchange between the solvent phase of line 48 and the solvent of line 57. Such additional heat-exchanger would also serve to cool the solvent in line 57, if necessary. The use of a distillation zone in the instant embodiment is not intended to be limiting since any means for decreasing the concentration of the anti-solvent in the extraction solvent may be employed. The use of a distillation zone is preferred when the anti-solvent is water since the steam generated therein may be advantageously and economically employed in this and/or other processes (not shown).

When water is the selected anti-solvent the solvent phase in line 48 is introduced to distillation zone 52 wherein water is distilled, preferably under pressure, and removed as steam via line 54. Steam in line 54 is heat exchanged at 22 with the mixed hydrocarbon feed after which the steam may be condensed by cooler 62, and the water condensate may be employed in extractors 38 and 39. Alternatively, the steam leaving heat exchanger 22 may be advantageously employed in this or other processes (not shown). Heat exchange at 22 may result in the condensation of small amounts of extraction solvent present in the steam (indicated at 22 by a dashed arrow). This solvent can be recycled to extraction column 24 by combining the solvent with the solvent from line 57 from distillation zone 52 (not shown). By such use of the process steam the heat input to the process may be, in part, heat supplied by steam heater 22 in conjunction with distillation zone 52.

As above discussed alternative schemes may be substituted for that above-described for the removal of the anti-solvent, depending on the selection of the anti-solvent. The above described scheme is particularly advantageous in terms of the reduction in energy required to carry out the instant process. For example, the above-described extraction-separation process results in a reduction in energy requirements for the dearomatization, as compared to conventional dearomatization processes, by as much as 50 percent to about 80 percent depending on the feed being subjected to dearomatization by use of the process hereunder.

The total anti-solvent, e.g. water in the system can be easily determined because the amount of water introduced at 46 to separation zone 34 can be controlled. Allowances must be made for water losses through leakage and upsets so as to maintain the amount of anti-solvent present in separation zone 34 at from about 0.5 to about 25.0 percent by weight and most preferably from about 5.0 to about 10.0 percent.

Figure 2:
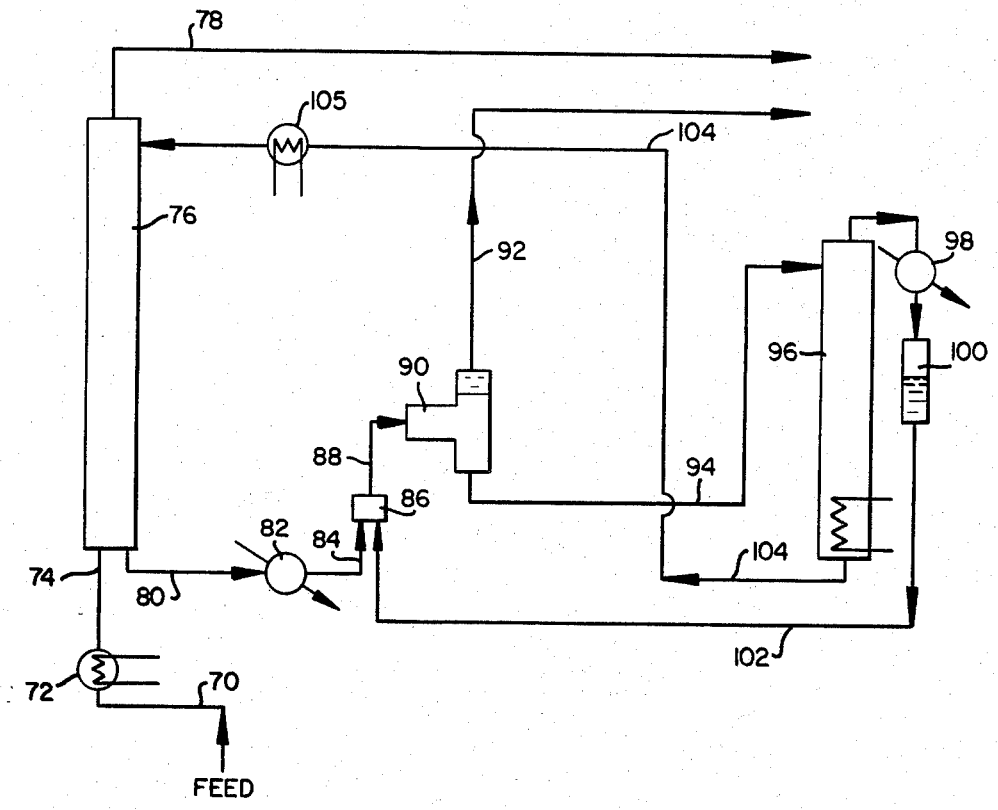
FIG. 2 is a schematic flow diagram of the process as employed in the examples.

Another scheme for carrying out the instant process is depicted in FIG. 2. In this process scheme certain features discussed in reference to the process depicted in FIG. 1 were not employed. The mixed hydrocarbon feed is introduced in line 70 from an external feed source (not shown) and was heated in heater 72. The heated feed then passed through line 74 to extraction column (zone) 76. Aromatic selective solvent was introduced near the top of extraction column 76 via line 104 after heating in heater 105. The extraction solvent percolates the down column 76 removing aromatics from the hydrocarbon feed, forming raffinate and an aromatic rich solvent phase (hereinafter designated RS as the phase for rich-solvent). The raffinate containing primarily non-aromatics, exits the top of column 76 via line 78 and is collected as raffinate product. This raffinate product is cooled and any extraction solvent separated by decantation. The raffinate product is then washed with water (not shown). The viscosity index of this raffinate product is then measured by measuring the refractive index of the raffinate at 70° C., as hereinbefore discussed.

The RS phase in line 80, containing primarily extraction solvent and aromatic hydrocarbons, is cooled in heat exchanger 82 (generally comprising one or more cold water heat exchanger in series) and is introduced to mixer 86. Mixer 86 is employed to feed and mix the contents of lines 84 and 102 to line 88 for introduction to separation zone 90. Mixer 86 herein comprises a mechanical magnetic stirrer. Anti-solvent (in the instant examples water is the anti-solvent) is introduced via line 102 and the RS and the anti-solvent are mixed and introduce separation zone 90. In this embodiment the separation zone may be a tank or a fibrous bed coalescer such as available from Sealas Corporation (Model No. LS-60P). In addition, it may be desirable to employ a filter in line 88 (not shown), e.g., an in line cotton filter, to remove solids that may be present in the phase in line 88. This is especially desirable when a fibrous bed coalescer is employed and such a filter was employed herein when a fibrous bed coalescer was employed. The anti-solvent may be added to separation zone 90 directly if desired, i.e., line 102 may alternatively be introduced to separation zone 90 although such is not preferred. As aforementioned, the cooling by means of heat exchanger 82 and the addition of the anti-solvent reduces the solubility of the aromatic hydrocarbon in the extraction solvent such that an aromatic-rich extract phase is formed and a solvent phase is formed containing as the major component the extraction solvent and anti-solvent (hereinafter referred to as the wet LS (lean solvent)phase.

The aromatic-rich extract phase of separator zone 90 leaves decantation zone 90 through line 92.

The wet LS phase of separation zone 90 leaves the separation zone via line 94 and is introduced to water stripper 96 wherein some portion of the water (the selected anti-solvent herein) in the wet LS phase may be removed by condensing in water condenser 98 and introduced to water accumulator 100. Water, employed as the anti-solvent, is introduced via line 102, as required to provide the desired concentration of water (anti-solvent) in separation zone 90. Solvent exits water stripper 96 (hereinafter referred to as the dry LS (lean solvent) phase via line 104 and is introduced to extraction zone 76 after heating in heater 105 as hereinbefore discussed. The dry LS phase contains some amount of water and may contain up to about 10 percent by weight water or higher. Typically the dry LS contains less tnan about 10 percent by weight water. As hereinbefore noted, the amount of water present in the dry LS may be advantageously adjusted to provide enhanced performance of the mixed extraction solvent with different feedstocks. This adjustment of the amount of antisolvent in the LS phase may be made by adjustment of the temperature and pressure in the antisolvent removal zone. Accordingly, the capacity and selectivity of the mixed extraction solvent can be correlated to the specific feedstock being treated by the correlation of the feedstock, mixed extraction solvent and the amount of water present in the recycled mixed extraction solvent (dry LS). As hereinbefore discussed, a small amount of oil may also be present in the dry LS phase.

The following examples are provided to illustrate the invention and are not to be construed as limiting such in any way.

EXAMPLES 1–8

Examples 1 to 8 of Table I show the advantages derived from the use of the process of this invention and the mixed extraction solvent employed therein. Examples 1 to 8 were carried out employing the process depicted in FIG. 2. Examples 1 and 2 are comparative examples wherein only the solvent triethylene glycol and tetraethylene glycol were employed, respectively. The temtperature of the Lean Solvent introduced in the extraction zone was about 235° C.±5° C. and the temperature in the separation zone was 65° C.±5° C.

Examples 3 to 8 show that by use of a mixed extraction solvent comprising tetraethylene glycol as the solvent and a glycol ether, as above described, as the cosolvent. As shown in Table I, a process is obtained wherein lower solvent to oil ratios and lower water to oil ratios may be employed while the quality of the product is retained or improved. The feedstock was bright stock having a refractive index at 70° C. of 1.4820 (viscosity index of 91).

Examples 3 to 8 show that by use of the mixed extraction solvent that the solvent to oil ratio can be reduced while maintaining or improving the viscosity index of the raffinate and while lowering the amount of water required to wash the raffinate and extract products, i.e., lower water to feed ratios.

TABLE I

| Example | Solvent[1] | S/O[2] | $H_2O$/Feed[3] | LS[4] Temp | Waxy Raffinate (% Yield) | Waxy Raffinate[5] (VI) | Waxy Raffinate[5] (RI) |
|---|---|---|---|---|---|---|---|
| 1 | TEG | 13.5 | 1.19 | 232 | 81 | 99 | 1.4780 |
| | | 14.3 | 0.93 | 235 | 82 | 98 | 1.4786 |
| 2 | TETRA | 13.4 | 0.861 | 236 | 72 | 101 | 1.4754 |
| | | 16.9 | 1.050 | 235 | 70 | 101 | 1.4755 |
| | | 14.2 | 0.518 | 235 | 74 | 100 | 1.4763 |
| 3 | 20 wt. % ETG/TETRA | 10.0 | 0.541 | 232 | 75 | 100 | 1.4763 |
| | | 9.4 | 0.57 | 230 | 77 | 100 | 1.4767 |
| | | 7.8 | 0.56 | 230 | 79 | 99 | 1.4770 |
| 4 | 30 wt % ETG/TETRA | 9.4 | 0.283 | 221 | 66 | 101 | 1.4753 |
| | | 7.9 | 0.248 | 220 | 71 | 100 | 1.4768 |
| 5 | 25 wt % MTG/TETRA | 7.9 | 0.239 | 221 | 71 | 100 | 1.4760 |
| | | 6.1 | 0.248 | 221 | 77 | 99 | 1.4775 |
| 6 | 30 wt % MTG/TETRA | 9.7 | 0.608 | 231 | 53 | 103 | 1.4730 |
| | | 7.8 | 0.595 | 231 | 68 | 101 | 1.4755 |
| | | 8.2 | 0.600 | 231 | 72 | 100 | 1.4759 |
| 7 | 44.5 wt % MTG/TETRA | 7.9 | 0.203 | 221 | 54 | 103 | 1.4731 |
| 8 | 11.5 wt % BTG/TETRA | 9.7 | 0.861 | 231 | 70 | 101 | 1.4750 |
| | | 8.1 | 0.686 | 235 | 73 | 100 | 1.4758 |
| | | 8.3 | 0.736 | 235 | 75 | 100 | 1.4764 |

[1]TEG = triethylene glycol; TETRA = tetraethylene glycol; MTG = methoxyglycol; ETG = ethoxytriglycol; and BTG = butoxytriglycol.
[2]S/O = Solvent to Oil (Feed) Ratio, by volume
[3]The ratio of $H_2O$ to feed, by volume, denotes the volume of $H_2O$ added to the cool rich solvent prior to the separation zone relative to the amount of feed introduced to the extraction zone. This water may be employed to wash the raffinate and/or extract to further remove solvent therefrom
[4]LS = Lean Solvent temperature (°C.)
[5]VI = Viscosity index; RI = refractive index (at 70° C.)

What is claimed is:

1. The mixed extraction solvent for the separation of aromatic and nonaromatic components of a mixed hydrocarbon feed comprising a polyalkylene glycol of the formula:

$$HO—[CHR_1—(CR_2R_3)_n—O—]_mH$$

wherein n is an integer from 1 to 5, m is an integer from 1 to 10, and $R_1$, $R_2$ and $R_3$ may be each be hydrogen, alkyl, aryl, araalkyl and mixtures thereof; and between about 0.5 and 99 percent by weight based on the total weight of the mixed extraction solvent of a polyalkylene glycol ether of the formula $$R_4O—[CHR_5—(CHR_6)_xO]_y—R_7$$

wherein x is an integer from 1 to 5 and y is an integer from 2 to 10 and wherein $R_4$, $R_5$, $R_6$ and $R_7$ may each be alkyl, aryl, aralkyl, alkyl aryl and mixtures thereof with the priviso that $R_4$ or $R_7$ are not both hydrogen.

2. The mixed extraction solvent of claim 1 consisting essentially of a mixture of a polyalkylene glycol selected from the group consisting of triethylene glycol, tetraethylene glycol and mixtures thereof and a glycol ether selected from the group consisting of $$R_4O—[CHR_5—(CHR_6)—_xO_y—R_7$$

wherein x is 1 and y is an integer between about 3 and about 6 and wherein $R_4$, $R_5$, $R_6$ and $R_7$ are alkyl having from 1 to 10 carbon atoms or are hydrogen with the proviso that $R_4$ and $R_7$ are not both hydrogen.

3. The mixed extraction solvent of claim 2 wherein $R_4$ is one of methyl, ethyl, propyl or butyl or mixtures thereof; $R_5$, $R_6$ and $R_7$ are hydrogen; x is 1; and y is 3.

4. The process for the dearomatization of a mixed hydrocarbon feed which comprises the following steps:

(a) contacting said feed in an extraction zone at a temperature of at least about 150° C. with a mixed extraction solvent comprising a polyalkylene glycol of the formula:

$$HO—[CHR_1—(CR_2R_3)_n—O—]_mH$$

wherein n is an integer from 1 to 5, m is an integer having a value of 1 or greater and $R_1$, $R_2$ and $R_3$ may each be hydrogen, alkyl, aryl, araalkyl, alkylaryl and mixtures thereof and a glycol ether of the formula:

$$R_4O—[CHR_5—(CHR_6)_xO]_y—R_7$$

wherein $R_4$, $R_5$, $R_6$ and $R_7$ may each be hydrogen, alkyl, aryl, araalkyl, alkylaryl and mixtures thereof with the proviso that $R_4$ and $R_7$ are not both hydrogen; x is an integer from 1 to 5; and y may be an integer from 2 to 10; to provide a solvent phase containing aromatic hydrocarbons and a raffinate phase containing nonaromatic hydrocarbons;

(b) cooling said solvent phase;

(c) introducing said cooled solvent phase to a separation zone and introducing threrewith an effective amount of an anti-solvent for said aromatic hydrocarbons in said mixed extraction solvent to provide an extract phase containing aromatic hydrocarbons and a solvent phase containing mixed extraction solvent and anti-solvent;

(d) recovering the extract phase of step (c) and the raffinate phase of step (a).

5. Process according to claim 4 which includes the additional step of removing anti-solvent from the solvent phase of step (c) and recycling said solvent phase to step (a).

6. The process of claim 4 wherein the mixed extraction solvent consists essentially of a polyalkylene glycol selected from the class consisting of diethylene glycol, triethylene glycol, tetraethylene glycol and mixtures thereof and a glycol ether selected from the class consisting of methoxytriglycol, ethoxytriglycol, butoxytriglycol, methoxytetraglycol and ethoxytetraglycol and mixtures thereof wherein the glycol ether comprises between about 0.5 and 99 percentage by weight of the mixed extraction solvent.

7. The process of claim 6 wherein the polyalkylene glycol is tetraethylene glycol and the glycol ether is methoxytriglycol.

8. The process of claim 4 wherein the anti-solvent in step (c) is employed in an amount from about 0.5 to about 25.0 percent by weight.

9. The process of claim 8 wherein the anti-solvent in step (c) is employed in an amount from about 0.5 to about 15.0 percent by weight.

10. The process of claim 4 wherein the anti-solvent is water.

11. The process of claim 6 wherein the anti-solvent is water.

12. The process of claim 4 wherein the temperature in the extraction zone is from about 150° C. to about 275° C.

13. The process of claim 4 wherein the temperature in the separation zone is from about 25° C. to about 150° C.

14. The process of claim 12 wherein the temperature in the extraction zone is from about 170° C. to about 250° C.

15. The process of claim 13 wherein the temperature in the separation zone is from about 25° C. to about 100° C.

16. The process of claim 15 wherein the temperature in the separation zone is from about 25° C. to about 70° C.

17. The process of claim 4 wherein the ratio of solvent to feed in the extraction zone of step (a) is in the range of about 4 to about 12 parts by volume of solvent to one part by volume of feed.

18. The process of claim 4 which includes the additional step of separately contacting the raffinate and extract of step (e) witn water to form two water phases containing primarily water and mixed extraction solvent.

19. The process of claim 18 which includes the additional step of recovering the extraction solvent of the water phases and recycling said solvent to step (c).

20. The process of claim 4 or 16 wherein less than about three percent by weight aromatic hydrocarbon is present in the solvent phase of step (c).

21. The process of claim 20 wherein from about 0.5 to about 15.0 percent of weight water is employed in step (c).

22. The process of claim 21 wherein from about 5.0 to about 10.0 percent by weight water is employed in step (c).

23. The process for the dearomatization of a mixed hydrocarbon feed comprising a lubricating oil fraction which comprises the following steps:

(a) contacting said feed at a temperature of from about 150° C. to about 275° C. in an extraction zone with a mixed extraction solvent:

comprising a polyalkylene glycol of the formula:

$$HO—[CHR_1—(CR_2R_3)_n—O—]_mH$$

wherein n is an integer from 1 to 5, m is an integer from 1 to 10, and $R_1$, $R_2$ and $R_3$ may be each be hydrogen, alkyl, aryl, araalkyl and mixtures thereof; and between about 0.5 and 99 percent by weight based on total weight of the mixed extraction solvent of a polyalkylene glycol ether of the formula:

$$R_4O—[CHR_5—(CHR_6)_xO]_y—R_7$$

wherein x is an integer from 1 to 5 and y is an integer from 2 to 10 and wherein $R_4$, $R_5$, $R_6$ and $R_7$ may each be alkyl, aryl, aralkyl, alkyl aryl and mixtures thereof with the proviso that $R_4$ or $R_7$ are not both hydrogen;

to provide a solvent phase and a raffinate;

(b) cooling said solvent phase;

(c) introducing said cooled solvent phase to a separation zone at a temperature between about 10° C. and about 70° C. and having present therewith from about 0.5 and about 25.0 percent by weight water to provide an extract phase containing aromatic hydrocarbons and a solvnet-rich phase containing mixed extraction solvent and water;

(d) removing water present in the mixed extraction solvent;

(e) recycling the mixed extraction solvent of step (d) to step (a);

(f) separately contacting the raffinate of step (a) and the extract of step (c) with water to form two water phases;

(g) combining the water phases of step (f);

(h) recycling at least a portion of the combined water phase of step (g) to step (c); and (i) recovering the extract and raffinate of step (f).

24. The process of claim 23 wherein less than about two percent by weight aromatic hydrocarbon is present in the solvent phase of step (c).

25. The process of claim 23 wherein the temperature in the extraction zone of step (a) is from about 200° C. to about 240° C.

26. The process of claim 23 wherein the temperature in the separation zone is from about 25° C. to about 70° C.

27. The process of claim 23 wnerein the ratio of solvent to feed in the extraction zone of step (a) is in the range of about 4 to about 12 parts of weight of solvent to one part by weight of feed.

28. The process of claim 23 wherein the temperature of the extraction zone is from about 200° C. to about 240° C.

29. The process of claim 23 wherein the mixed extraction solvent of step (e) contains an effective amount of water, said effective amount being correlated to the selected feedstock and mixed extraction solvent.

30. The process of claim 29 wherein the amount of water in the mixed extraction solvent is up to about 10 percent by weight.

31. In a process for the dearomatization of a mixed hydrocarbon feed comprising the steps of:

(a) contacting said feed in an extraction zone at a temperature of at least about 150° C. with extraction solvent to provide a solvent phase containing aromatic hydrocarbons and a raffinate phase containing nonaromatic hydrocarbons;
(b) cooling said solvent phase;
(c) introducing said cooled solvent phase to a separation zone and introducing therewith an effective amount of an anti-solvent for said aromatic hydrocarbons in said mixed extraction solvent to provide an extract phase containing aromatic hydrocarbons and a solvent phase containing mixed extraction solvent and anti-solvent;
(d) removing anti-solvent from said solvent phase and recycling said solvent phase to the extraction zone of step (a); and
(e) recovering the extract phase of step (c) and the raffinate phase of step (a); the improvement comprising employing as the extraction solvent a mixed extraction solvent consisting essentially of a mixture of a polyalkylene glycol of the formula:

$$HO—[CH_2—(CH_2)_n—O]_mH$$

wherein n is an integer from 1 to 5 and m is an integer having a value of 1 or greater and a glycol ether of the formula:

$$R_4O—[CHR_5—(CHR_6)_xO]_y—R_7$$

wherein x is an integer from 1 to 5 and y is an integer from 2 to 10, and wherein $R_4$, $R_5$, $R_6$ and $R_7$ may each be hydrogen or alkyl containing from 1 to 10 carbon atoms with the proviso that $R_4$ and $R_7$ are not both hydrogen.

* * * * *